US008979089B2

(12) United States Patent
Mano

(10) Patent No.: US 8,979,089 B2
(45) Date of Patent: Mar. 17, 2015

(54) SHEET POST-PROCESSING APPARATUS, IMAGE FORMING APPARATUS AND SHEET POST-PROCESSING METHOD

(75) Inventor: Shinichiro Mano, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 868 days.

(21) Appl. No.: 12/779,713

(22) Filed: May 13, 2010

(65) Prior Publication Data

US 2010/0289207 A1 Nov. 18, 2010

Related U.S. Application Data

(60) Provisional application No. 61/178,423, filed on May 14, 2009, provisional application No. 61/187,199, filed on Jun. 15, 2009.

(51) Int. Cl.

| | |
|---|---|
| ***B65H 43/00*** | (2006.01) |
| ***B65H 29/14*** | (2006.01) |
| ***B65H 29/26*** | (2006.01) |
| ***B65H 31/36*** | (2006.01) |
| ***G03G 15/00*** | (2006.01) |

(52) U.S. Cl.

CPC ..... *B65H 29/14* (2013.01); *B65H 29/26* (2013.01); *B65H 31/36* (2013.01); *G03G 15/5029* (2013.01); *G03G 15/6573* (2013.01); *B65H 2404/144* (2013.01); *B65H 2511/51* (2013.01); *B65H 2551/20* (2013.01); *B65H 2555/26* (2013.01); *B65H 2601/251* (2013.01); *B65H 2601/271* (2013.01); *B65H 2701/11312* (2013.01); *B65H 2701/1313* (2013.01); *B65H 2801/06* (2013.01)

USPC ..... 271/176; 270/58.07

(58) Field of Classification Search

USPC ..... 271/3.14, 3.15, 258.01, 306, 176, 199, 271/207, 272, 273, 274, 314; 270/258.04, 270/58.07, 58.08, 58.11, 58.12, 58.17; 399/405

See application file for complete search history.

(56) References Cited

U.S. PATENT DOCUMENTS

| | | | | |
|---|---|---|---|---|
| 2,192,414 | A * | 3/1940 | Reed | 271/274 |
| 7,077,393 | B2 * | 7/2006 | Ishida | 270/37 |
| 2008/0006991 | A1 * | 1/2008 | Kimura et al. | 271/207 |

(Continued)

FOREIGN PATENT DOCUMENTS

| | | | |
|---|---|---|---|
| EP | 2112112 | * | 10/2009 |
| JP | 57-167066 | * | 10/1982 |
| JP | 2005-324932 | A | 11/2005 |

(Continued)

*Primary Examiner* — Thomas Morrison

(74) *Attorney, Agent, or Firm* — Patterson & Sheridan, LLP

(57) ABSTRACT

According to one embodiment, a sheet post-processing apparatus includes a machine body, a first roller pair, a tray, a second roller pair, a driving unit, an inlet sensor, a receiving unit and a control unit. The inlet sensor is configured to detect presence or absence of the sheet in the first roller pair driven by the driving unit. The receiving unit is configured to receive, from an image forming apparatus, sheet length information in the sheet conveying direction of the sheet as a target to which the print job is applied. The control unit is configured to control the driving unit to rotate, if the sheet length information indicates special length and the inlet sensor detects a trailing end of the sheet, at least rollers of the second roller pair a predetermined number of times and stop the rollers, the second roller pair nipping the sheet.

11 Claims, 13 Drawing Sheets

(56) References Cited

U.S. PATENT DOCUMENTS

2008/0284091 A1* 11/2008 Sekiyama et al. ..... 271/226
2009/0257768 A1* 10/2009 Ando et al. ..... 399/68

FOREIGN PATENT DOCUMENTS

JP 2006-69752 A 3/2006
JP 2007-276173 A 10/2007

* cited by examiner

SHEET POST-PROCESSING APPARATUS, IMAGE FORMING APPARATUS AND SHEET POST-PROCESSING METHOD

CROSS-REFERENCE TO RELATED APPLICATION

The present application claims the priority benefit of the next U.S. Provisional Applications: U.S. Provisional Application Ser. Nos. 61/178,423, entitled SHEET FINISHER WITH APPARATUS FOR FORMING IMAGE ON LONG SHEET, to MANO, filed on May 14, 2009, and 61/187,199, entitled IMAGE FORMING APPARATUS, to MANO, filed on Jun. 15, 2009, the entire contents of which are hereby incorporated by reference.

TECHNICAL FIELD

Embodiments described herein relates generally to a sheet post-processing apparatus, an image forming apparatus, and a sheet conveying method, and a method with which, when the image forming apparatus applies printing to a long sheet, the sheet post-processing apparatus outputs the sheet.

BACKGROUND

A sheet post-processing apparatus configured to apply post-processing to a sheet is connected to an image forming apparatus such as an MFP (Multi-Functional Peripheral), a copying machine, or a printer. The image forming apparatus forms an image on the sheet and discharges the sheet. The sheet post-processing apparatus executes post-processing such as sorting or stapling on the sheet.

Sheets supplied to the sheet post-processing apparatus are cut sheets (cut paper). The cut sheets have sheet sizes. The sheet sizes are classified into plural kinds of standard sizes according to sheet widths and sheet lengths.

The sheet widths indicate sheet dimensions in a direction orthogonal to a sheet conveying direction in which the sheets are conveyed. The sheet lengths indicate sheet dimensions in the sheet conveying direction.

There are various standard sizes such as ISO (International Standard) A3 and A4, LD (ledger), LT (letter), LG (legal), and tabloid. The tray length of a paper discharge tray is adjusted to any one of all the kinds of standard sizes.

In some case, a long sheet having sheet length of, for example, 1200 mm is used for hanger displays in vehicles.

When the image forming apparatus forms an image on the long sheet, the long sheet is set on a manual feed tray. The sheet post-processing apparatus conveys the long sheet to an upper paper discharge tray through a space on the upper side.

The image forming apparatus prints the long sheet (a special sheet) and outputs the long sheet to the sheet post-processing apparatus. In this case, the size of the long sheet is not a size of a sheet stacked on a fixed tray or a movable tray. Therefore, the sheet post-processing apparatus directly drops and outputs the long sheet onto the floor surface.

However, when the printed long sheet is dropped and output onto the floor surface from the sheet post-processing apparatus, the printed long sheet or an image printed on the long sheet is soiled or the long sheet is scratched.

When a tray having tray length enough for stacking the long sheet is provided in the sheet post-processing apparatus, the size of the sheet post-processing apparatus becomes excessively large. The tray causes a problem in setting the image forming apparatus and the sheet post-processing apparatus.

It is difficult to stack the long sheet on the fixed tray and the movable tray without bending the long sheet and without scratching the long sheet.

It is necessary to provide a dedicated member for conveying the long sheet in the sheet post-processing apparatus. In other words, it is necessary to separately provide a component in the sheet post-processing apparatus.

DETAILED DESCRIPTION

Figure 1:
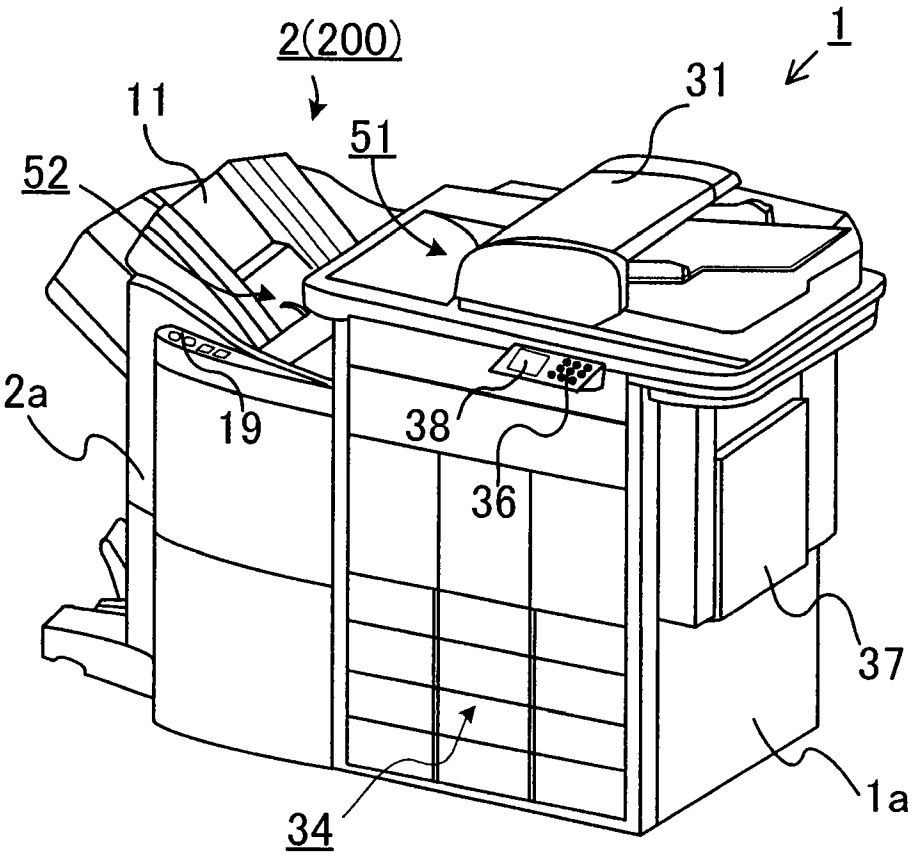
FIG. 1 is a perspective view of an image forming apparatus and a sheet post-processing apparatus according to a first embodiment.

According to one embodiment, a sheet post-processing apparatus includes a machine body, a first roller pair, a tray, a second roller pair, a driving unit, an inlet sensor, a receiving unit and a control unit. The machine body has a post-processing mechanism configured to apply post-processing to a sheet. The first roller pair is provided in the machine body and configured to receive a sheet on which an image is formed by an image forming apparatus in a print job and nip and convey the sheet. The tray is provided further on a downstream side in a sheet conveying direction than the first roller pair. On the tray the sheet discharged from the first roller pair is stacked. The second roller pair is provided in a conveying path defined between the tray and the first roller pair and configured to nip and convey the sheet. The driving unit is configured to drive the second roller pair and the first roller pair. The inlet sensor is configured to detect presence or absence of the sheet in the first roller pair driven by the driving unit. The receiving unit is configured to receive, from the image forming apparatus, sheet length information in the sheet conveying direction of the sheet as a target to which the print job is applied. And the control unit is configured to control the driving unit to rotate, if the sheet length information indicates special length and the inlet sensor detects a trailing end of the sheet, at least rollers of the second roller pair a predetermined number of times and stop the rollers, the second roller pair nipping the sheet.

According to one embodiment, a sheet post-processing apparatus includes a machine body, a fixed tray and a movable tray. The machine body has a structural shape and apparatus size equivalent to a structural shape and apparatus size of an existing sheet post-processing apparatus. The sheet post-processing apparatus outputs a long sheet printed by an image forming apparatus without bending the long sheet, without dropping the long sheet onto the floor surface, and without scratching the long sheet.

Throughout this description, the embodiments and examples shown should be considered as exemplars, rather than limitations on the apparatus and methods.

A sheet post-processing apparatus, an image forming apparatus, a sheet post-processing method are explained in detail below with reference to the accompanying drawings as examples. In the figures, the same components are denoted by the same reference numerals and signs and redundant explanation of the components is omitted.

(First Embodiment)

An image forming apparatus according to a first embodiment is an MFP having a color copying function for an original document. A sheet post-processing apparatus according to the first embodiment is a finisher coupled to the MFP.

A sheet post-processing method according to the first embodiment is a method with which the finisher conveys a long sheet when the MFP applies printing to the long sheet.

The long sheet indicates a cut sheet having a dimension larger than the tray length of a tray for paper discharge. Alternatively, the long sheet indicates a long cut sheet having sheet length larger than the sheet length of a standard size sheet.

Figure 2:
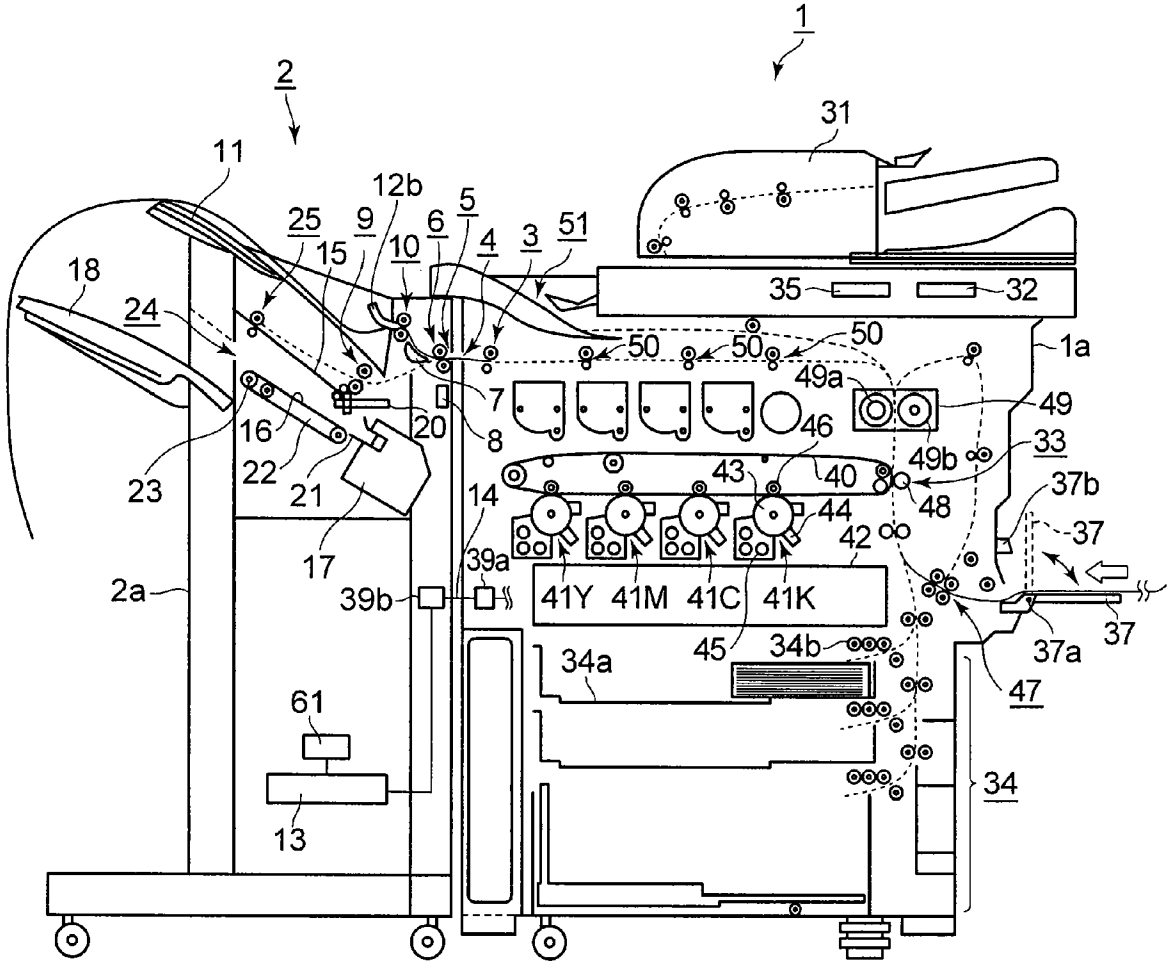
FIG. 2 is a diagram of an internal configuration example of the image forming apparatus and the sheet post-processing apparatus according to the first embodiment.
Figure 3:
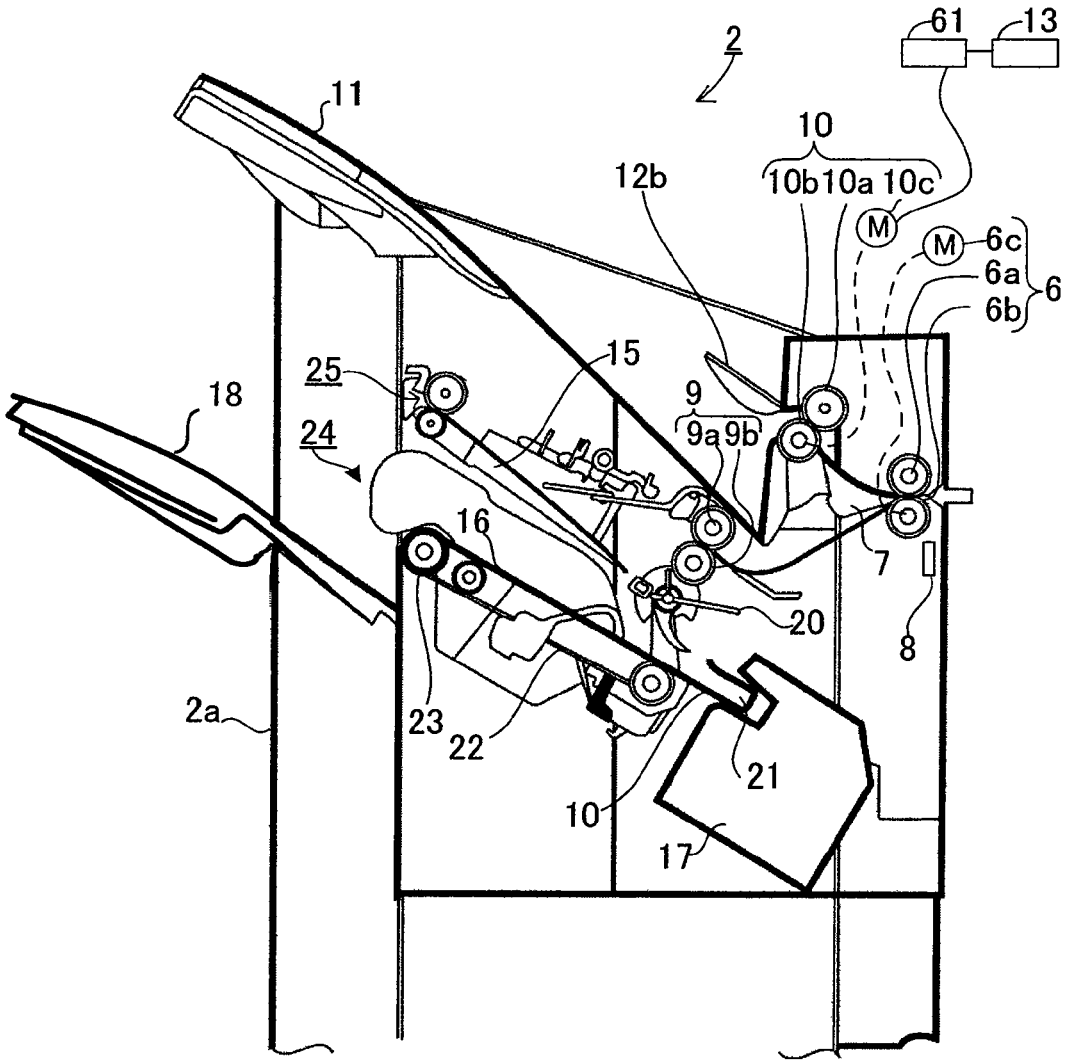
FIG. 3 is an enlarged diagram of the sheet post-processing apparatus according to the first embodiment.

FIG. 1 is a perspective view of the MFP and the finisher. FIG. 2 is a diagram of an internal configuration example of the MET and the finisher. FIG. 3 is an enlarged diagram of the finisher shown in FIG. 2. In these figures, the same components are denoted by the same reference numerals and signs.

An MFP 1 forms images on the long sheet and the standard size sheet and conveys the sheets to a finisher 2.

The finisher 2 discharges the long sheet and the standard size sheet without subjecting the long sheet and the standard size sheet to post-processing. The finisher 2 subjects the standard size sheet to the post-processing and discharges the standard size sheet. The post-processing for a sheet indicates stacking, sorting, and stapling for plural pages.

A discharge roller pair 3 discharges a printed-out sheet from a discharge port 4. A supply port 5 of the finisher 2 is connected to the discharge port 4.

The finisher 2 includes an inlet roller pair 6 (a first roller pair) provided near the supply port 5, a directing member 7 configured to lead a sheet output from the inlet roller pair 6 to an upper space or a lower space, and a sheet inlet sensor 8 (an inlet sensor).

The inlet roller pair 6 is the first roller pair configured to receive a sheet from the MFP 1 and conveys and outputs the sheet. The inlet roller pair 6 includes an upper roller 6*a*, a lower roller 6*b*, and a sheet conveying path motor 6*c* (a driving unit). The sheet conveying path motor 6*c* drives the lower roller 6*b*. A stepping motor is used as the sheet conveying path motor 6*c*.

The sheet inlet sensor 8 detects the passage of the leading end and the trailing end in a conveying direction of a sheet through the inlet roller pair 6.

The directing member 7 is operable to swing around an axis parallel to a depth direction of a machine body 2*a*. The depth direction indicates a direction from the front side to the rear side of the machine body 2*a*.

The upper space and the lower space are formed further on a downstream side in the sheet conveying direction than the directing member 7. A finisher control unit 13 controls a position around an axis of the directing member 7.

The upper space defines a path for discharging the standard size sheet without subjecting the standard size sheet to the post-processing. The finisher 2 discharges the long sheet to the outside of the machine body 2*a* via the upper space. The lower space defines a path for applying the post-processing to the standard size sheet and discharging the standard size sheet.

When the finisher 2 executes the post-processing, the directing member 7 closes the upper space and leads the standard size sheet to a paper feeding roller pair 9 via the lower space. The paper feeding roller pair 9 includes an upper roller 9*a* and a lower roller 9*b*.

When the finisher 2 does not execute the post-processing, the directing member 7 closes the lower conveying path and leads the long sheet or the standard size sheet to a last roller pair 10 (a second roller pair) via the upper conveying path.

The last roller pair 10 includes an upper roller 10*a*, a lower roller 10*b*, and a motor 10*c* (a driving unit). The motor 10*c* is a motor configured to rotate the lower roller 10*b*. A stepping motor is used as the motor 10*c*. The upper roller 10*a* is a driven roller.

The sheet conveying path motor 6*c*, the motor 10*c*, and a motor driver IC (Integrated Circuit) 61 (a driving unit) cooperate with one another, whereby function of the driving unit is realized. The driving unit drives to rotate each roller of the inlet roller pair 6 and each roller of the last roller pair 10 independently from each other. The driving unit is controlled by the finisher control unit 13.

The last roller pair 10 discharges the long sheet and the standard size sheet to a fixed tray 11 (a tray). The fixed tray 11 is a last tray provided at a terminal end further on the downstream side in the sheet conveying direction than the inlet roller pair 6.

Specifically, the last roller pair 10 is provided in a conveying path defined between the fixed tray 11 and the inlet roller pair 6. A sheet conveyed from the inlet roller pair 6 is stacked on the fixed tray 11. The fixed tray 11 has length corresponding to the standard size sheet.

When the standard size sheet is caused to travel to the fixed tray 11, the last roller pair 10 drops the standard size sheet onto a stack surface of the fixed tray 11. In the case of the standard size sheet, the last roller pair 10 conveys plural sheets to the fixed tray 11 one after another.

A fixed tray sheet sensor 12 (a sheet sensor) provided in an upper part of the fixed tray 11 detects that the fixed tray 11 is full.

"Full" indicates a situation in which the last roller pair 9 is stopped in a state in which the long sheet is nipped and a situation in which a bundle of the standard size sheets fills the fixed tray 11.

Figure 4:
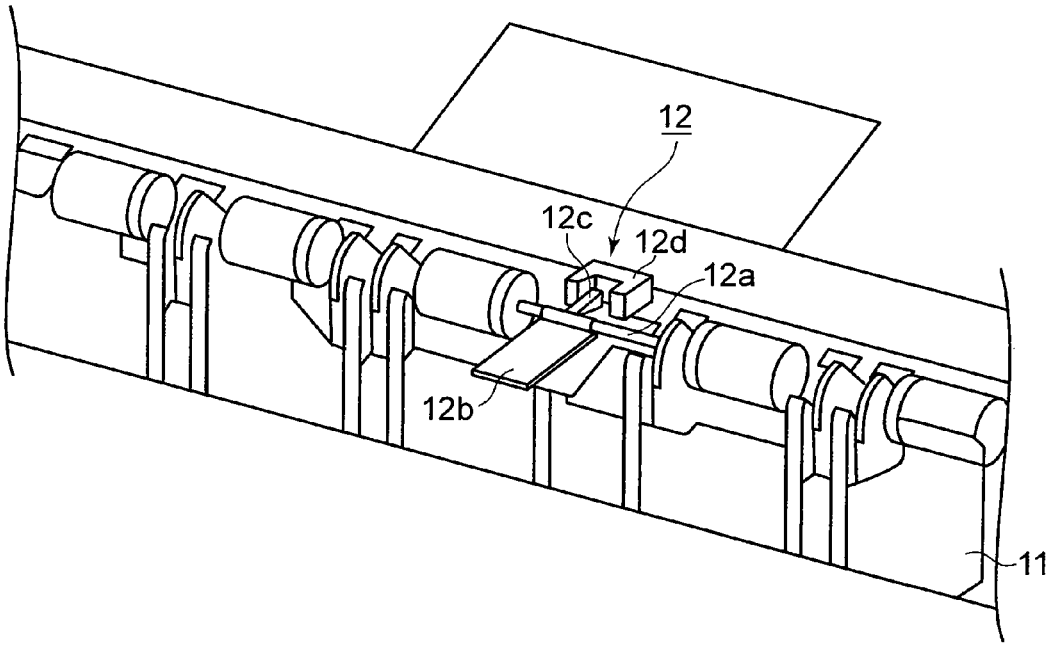
FIG. 4 is a partial perspective view of a fixed tray sheet sensor viewed from the outside of a machine body.

FIG. 4 is a partial perspective view of the fixed tray sheet sensor 12 viewed from the outside of the machine body 2*a*. Reference numerals and signs same as those described to above denote the same components.

As an example, the fixed tray sheet sensor 12 includes a shaft 12*a*, an actuator 12*b* axially supported by the shaft 12*a*, a piece member 12*c* connected to the actuator 12*b*, and a sensor 12*d* configured to detect presence or absence of the piece member 12*c*.

The shaft 12*a* has an axis parallel to the depth direction.

The lower surface of the actuator 12*b* comes into contact with the upper surface of the long sheet or the standard size sheet. The actuator 12*b* is applied with upward force by the sheet and rotates around the shaft 12*a*.

The actuator 12*b* is mainly used in order to prevent misdetection due to the presence of a dead zone and stably detect a state in which a sheet is stacked in the fixed tray 11.

The piece member 12*c* is integrated with the actuator 12*b*. When the distal end of the actuator 12*b* is lifted upward, the piece member 12*c* is displaced downward. When the distal end is displaced downward, the piece member 12*c* is displaced upward.

The sensor 12*d* is, for example, a photointerrupter and has a laser diode and a photodiode. The sensor 12*d* detects blocking of light according to the position of the piece member 12*c*. The sensor 12*d* is electrically connected to the finisher control unit 13 (a control unit).

The stopping long sheet bends in a curve. The upper surface of the long sheet presses up the lower surface of the actuator 12*b* to turn on an output of the sensor 12*d*. The fixed tray sheet sensor 12 continues to output ON after the long sheet is put in the fixed tray 11.

Alternatively, the sensor output changes from OFF to ON when the fixed tray 11 is filled with the standard size sheets.

After causing the last roller pair 10 to convey the long sheet by a predetermined distance, the finisher control unit 13 causes the last roller pair 10 to nip the long sheet and stops the last roller pair 10.

The predetermined distance indicates a traveling distance starting in a portion where the leading end of the long sheet comes into contact with the last roller pair 10 and ending in a position where the trailing end of the long sheet comes into contact with the last roller pair 10.

The finisher control unit 13 stores in advance the number of steps of the sheet conveying path motor 6*c* and the motor 10*c* equivalent to the predetermined distance.

As an example, when there is only one kind of the sheet length of the long sheet used for printing, a ROM (Read Only Memory) of the finisher control unit 13 stores the number of steps.

When plural kinds of sheet lengths are used, the ROM stores data in which the sheet lengths and the number of steps are associated. Alternatively, when the plural kinds of sheet lengths are used, the ROM stores one or more calculation formulas for calculating the number of steps from the sheet lengths.

The stack surface of the fixed tray 11 is inclined. The fixed tray 11 has the upper end on the leading end side of a sheet and the lower end on the trailing end side of the sheet. The stack surface is inclined such that the upper end is higher than the lower end.

When the last roller pair 10 conveys the long sheet, the leading end of the long sheet hangs downward with the own weight thereof. When the last roller pair 10 sends the long sheet, the sheet leading end comes into contact with the stack surface and the sheet leading end slides upward on the stack surface.

The sheet leading end reaches the upper end of the fixed tray 11 according to the advance of the long sheet. When the last roller pair 10 further sends the long sheet, a total distance of the traveling of the long sheet exceeds the tray length of the fixed tray 11.

The sheet leading end extends beyond the upper end of the fixed tray 11. The sheet leading end begins to fall downward on a side of the finisher 2 while the long sheet bends the middle portion thereof.

When the number of motor steps reaches the number of steps stored in the ROM, the finisher control unit 13 stops the rotation of the motor 10*c*. The finisher control unit 13 controls the last roller pair 10 to keep the last roller pair 10 nipping the long sheet.

The finisher 2 still holds the long sheet. The long sheet is prevented a falling out from the finisher 2.

A post-processing mechanism for the standard size sheet is explained below.

The finisher 2 further includes, as shown in FIGS. 2 and 3, a waiting tray 15, a processing tray 16, a stapler 17, a paper discharge tray 18, and a finisher panel 19.

The waiting tray 15 has two guide members movable along the depth direction of the machine body 2*a*. The guide members have wall sections opposed to each other and supporting sections configured to support the lower surface of a sheet. The waiting tray 15 separates the guide members from each other according to belt driving or the like to thereby cause the sheet to fall with the own weight thereof.

The processing tray 16 is arranged below the waiting tray 15. The sheet fallen from the waiting tray 15 is stacked on the processing tray 16.

Not-shown another roller pair leads the sheet on the processing tray 16 to the stapler 17. The processing tray 16 aligns edges of plural sheets until the stapler 17 completes stapling.

A paddle 20 is provided obliquely below the waiting tray 15. The paddle 20 is located in a position to which the trailing ends in the conveying direction of the sheets fall. The paddle 20 rotates around an axis parallel to the depth direction to support the alignment of the edges of the sheets.

A stopper 21 is provided at the end on the stapler 17 side of the processing tray 16. The stopper 21 regulates the positions of the trailing ends of the sheets.

A conveyor belt 22 and a discharge roller 23 are provided below the processing tray 16. The conveyor belt 22 is driven to travel by two pulleys. The conveyor belt 22 conveys sorted or stapled sheets to the paper discharge tray 18. The conveyor belt 22 discharges the sheets to the paper discharge tray 18 from a discharge port 24.

The sheet on the waiting tray 15 may be discharged to the paper discharge tray 18 from the discharge port 24 by another roller pair 25 without being stapled.

The finisher control unit 13 controls the driving of the sheet conveying path motor 6*c* and the motor 10*c*. The finisher control unit 13 also controls a transmission mechanism for driving force generated by the sheet conveying path motor 6*c* and the motor 10*c*.

As an example, the finisher control unit 13 synchronizes the rotation of the sheet conveying path motor 6*c* and the rotation of the motor 10*c*.

Alternatively, a clutch is provided between the motor 10*c* and the lower roller 10*b* in advance. When the finisher control unit 13 rotates the sheet conveying path moor 6*c*, the finisher control unit 13 disengages the motor 10*c* and the lower roller 10*b* with the clutch.

The finisher control unit 13 includes a CPU (Central Processing Unit), a ROM, and a RAM (Random Access Memory). The finisher control unit 13 controls the operation of the finisher panel 19.

The finisher panel 19 receives an instruction by user operation and displays information. The finisher panel 19 is provided in an upper part of the finisher 2.

Figure 5:
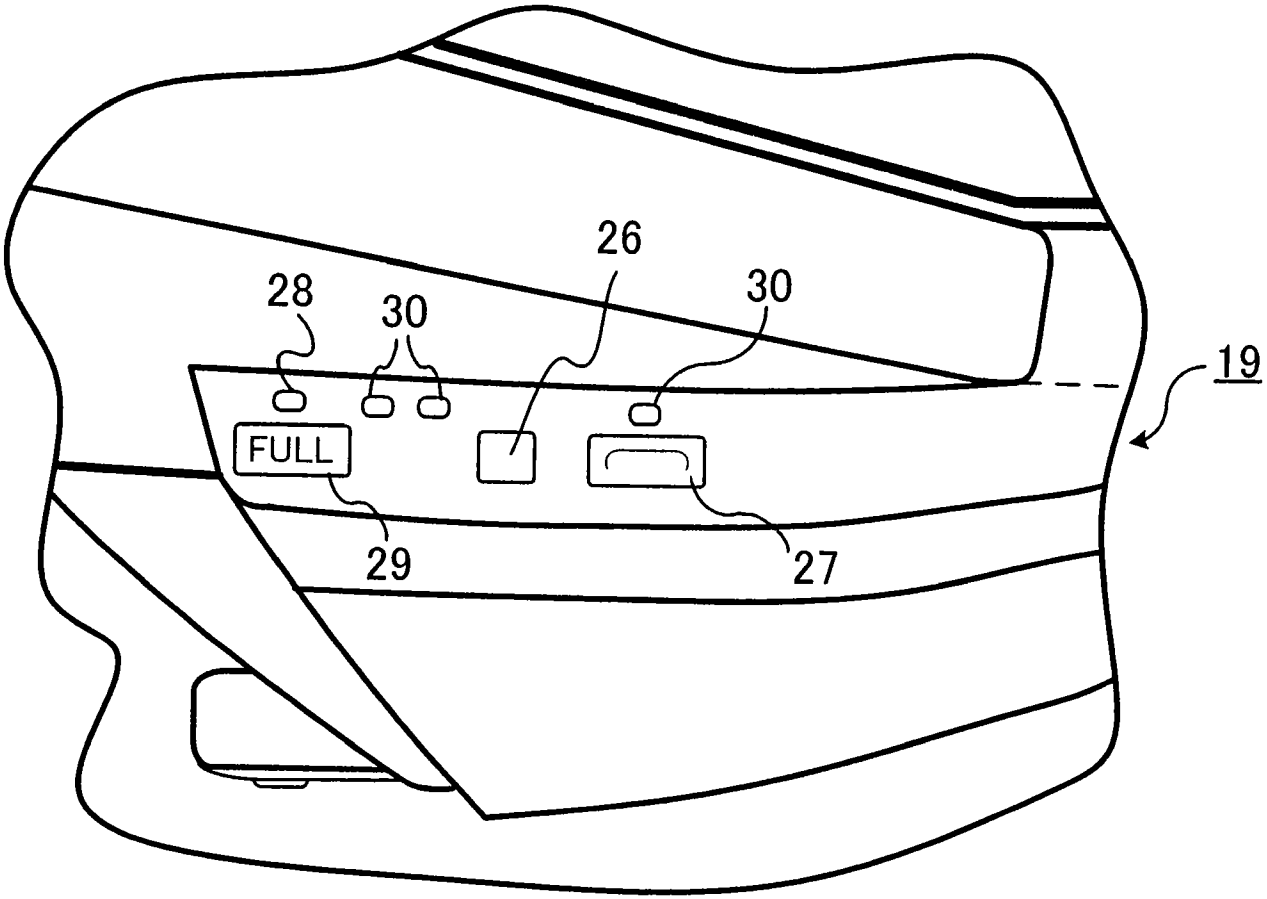
FIG. 5 is a partial perspective view of a finisher panel.

FIG. 5 is a partial perspective view of the finisher panel 19.

The finisher panel 19 includes a position selection button 26, a start button 27, an LED (Light Emitting Diode) 28, a confirmation button 29, and plural other LEDs 30. The finisher panel 19 also includes circuits for power supply and for driving.

The position selection button 26 is a direction key for selecting a position of stapling for sheets. The start button 27 is a key for starting the stapling.

The LED 28 configures a first display unit configured to display FULL. The LED 28 displays display data received from the finisher control unit 13.

As an example, the LED 28 is covered with a film member of synthetic resin on the like. A character string is silk-printed on the rear surface of the film member. The character string is "fixed tray sheet stack FULL" or the like. An area of plural character sections transmits a beam of light. An area different from the characters does not transmit a beam of light.

Alternatively, the finisher panel 19 may include a display device having a display function.

When notified that sheet length is large from the finisher control unit 13, the LED 28 is turned on and indicates that the last roller pair 10 nips the long sheet. The LED 28 informs a user that the long sheet should be removed from the finisher 2.

The confirmation button 29 is a key for the user to input confirmation concerning display by the LED 28. The other LEDs 30 are turned on or turned on and off according to content of operation of the buttons or a state of the finisher 2.

While the last roller pair 10 nips the long sheet, the finisher control unit 13 turns on or turns on and off the LED 28 for notification.

When the finisher control unit 13 detects depression operation of the confirmation button 29, the finisher control unit 13 drives the motor 10*c* for the last roller pair 10. The long sheet is discharged. The user grasps the long sheet.

The finisher 2 is mainly explained above. The MFP 1 is mainly explained below.

As shown in FIGS. 1 and 2, the MFP 1 includes a main body 1*a*, a scanner unit 31, an image processing unit 32, a printer unit 33, a paper feeding unit 34, an MFP control unit 35 (a control unit), and a control panel 36.

The machine body 1*a* is connected to the finisher 2. A manual feed tray 37 is provided on one side of the machine body 1*a*. A signal line 14 is wired between the MFP 1 and the finisher 2. The signal line 14 is a serial communication cable.

When an original document is inserted, the scanner unit 31 conveys the original document to a glass table. The scanner unit 31 includes an automatic document feeder, the glass table, a light source, plural carriages respectively having mirrors, a lens, and a photodiode.

The light source irradiates the lower surface of the glass table with a laser beam, the carriages move, and the scanner unit 31 scans a document surface. The lens causes a reflected beam from the mirror to converge. The photodiode photoelectrically converts the beam from the lens. The scanner unit 31 converts read image information into an analog signal.

The image processing unit 32 is an LSI (Large Scale Integration) configured to convert image data of three colors from the scanner unit 31 into four print colors.

The printer unit 33 forms an image on the long sheet or the standard size sheet and outputs the sheet.

The paper feeding unit 34 feeds a sheet to the printer unit 33. The paper feeding unit 34 includes plural stages of trays 34*a* in which sheets of standard sizes such as A3 and A4 are set and pickup rollers 34*b*.

The MFP control unit 35 is a main control unit configured to control the operation of the entire MFP 1. The MFP control unit 35 generates a print job. The printer unit 33 forms an image on a sheet according to the print job.

The MFP control unit 35 causes the finisher control unit 13 to execute post-processing designated by the print job. The MFP control unit 35 includes a CPU, a ROM, and a RAM.

The control panel 36 instructs the printer unit 33 to start image formation and instructs the scanner unit 31 to start document reading. The control panel 36 outputs a signal including various operation inputs, settings, and selection items to the MFP control unit 35.

The control panel 36 includes a display panel 38 (a second display unit). The display panel 38 displays various kinds of information received from the MFP control unit 35. The display panel 38 displays a dialog screen for urging the user to input the sheet length of the long sheet. The display panel 38 may display a dialog screen for causing the user to select any one of plural kinds of size information of long sheets stored in advance.

The manual feed tray 37 opens and closes around a shaft 37*a* horizontally provided on a side of the machine body 1*a*. The manual feed tray 37 includes a sensor 37*b* configured to detect which of a closed position and an open position the position of the manual feed tray 37 is. The sensor 37*b* is a micro switch.

When the manual feed tray 37 is expanded, the MFP control unit 35 detects a sensor output. When sheet length of the long sheet is input or selected through the control panel 36, the MFP control unit 35 transmits sheet length information to the finisher control unit 13 of the finisher 2 through the signal line 14.

UARTs (Universal Asynchronous Receiver/Transmitters) 39*a* and 39*b* are respectively provided in a terminal on the MFP 1 side and a terminal on the finisher 2 side of the signal line 14. The UART 39*a* (a transmitting unit) on the MFP 1 side and the UART 39*b* (a receiving unit) on the finisher 2 side are serial communication controllers.

The MFP control unit 35 and the finisher control unit 13 are enabled to transmit and receive information by the UART 39*a*, the signal line 14, and the UART 39*b*.

One of the UARTs 39*a* and 39*b* requests the other to perform communication and the other responds to the request, whereby a data link of asynchronous serial communication is established between the MFP control unit 35 and the finisher control unit 13.

The UART 39*a* as the transmitting unit transmits sheet length information of a sheet as a target of application of a print job to the finisher 2. The MFP control unit 35 as a control unit causes the UART 39*a* to transmit information (sheet length information) indicating that a sheet to be printed is the long sheet.

When the long sheet is inserted into the manual feed tray 37 or when an instruction is given to the control panel 36 by user operation, the MFP control unit 35 transmits information indicating the long sheet to the finisher control unit 13.

The UART 39*b* as the receiving unit receives the size information of the sheet and timing for starting driving of the inlet roller pair 6 from the MFP 1. The UART 39*b* as the transmitting unit transmits a control signal to the MFP 1.

When the size information received from the UART 39*b* indicates large length (special length) and the inlet sensor 8 detects the long sheet, the finisher control unit 13 rotates the inlet roller pair 6 and the last roller pair 10 by the number of pulses determined in advance.

Thereafter, the finisher control unit 13 controls the motor driver IC 61 to stop the inlet roller pair 6 and the last roller pair 10 in a state in which the last roller pair 10 nips the long sheet.

The control on the motor driver IC 61 by the finisher control unit 13 stops the inlet roller pair 6 and the last roller pair 10 at timing when the inlet roller pair 6 nips the trailing end of the long sheet.

The printer unit 33 is further explained below.

The printer unit 33 includes image forming units 41Y, 41M, 41C, and 41K for yellow (Y), magenta (M), cyan (C), and black (K), which are provided in parallel along an intermediate transfer belt 40, and a laser exposure device 42.

The image forming unit 41K includes a photoconductive drum 43, a charger 44, a developing device 45, and a transfer device 46. The photoconductive drum 43 holds a latent image. The charger 44 uniformly charges a photoconductor of the photoconductive drum 43. The laser exposure device 42 forms a latent image on the photoconductive drum 43. The developing device 45 develops the latent image on the photoconductive drum 43. The transfer device 46 transfers a developer image on the photoconductive drum 43 onto the intermediate transfer belt 40.

The configurations of the image forming units 41Y, 41M, and 41C are substantially the same as the configuration of the image forming unit 41K.

The MFP 1 includes a guide member and plural roller pairs for drawing up the standard size sheet from the paper feeding unit 34. The guide member and gaps of the plural roller pairs, each having one pair of rollers, define a conveying path for the sheet.

The plural roller pairs, a motor for conveyance, and gears configure a conveying mechanism configured to convey the sheet to the conveying path.

A roller pair 47 is provided in the manual feed tray 37. The manual feed tray 37 leads, to the conveying path, the long sheet or the standard size sheet supplied from the outside of the main body 1*a*.

The MFP 1 includes a secondary transfer roller pair 48 and a fixing device 49. The secondary transfer roller pair 48 transfers the developer image on the intermediate transfer belt 40 onto the long sheet or the standard size sheet.

The fixing device 49 fixes the developer image on the long sheet or the standard size sheet. The fixing device 49 includes a heat roller 49*a* and a press roller 49*b*. A driving motor drives the heat roller 49*a*. The press roller 49*b* is a driven roller.

The fixing device 49 conveys and outputs the sheet at speed instructed by the MFP control unit 35. Plural roller pairs 50 are provided further on the downstream side in the sheet conveying direction than the fixing device 49. The fixing device 49 and the roller pairs 50 define another conveying path continuous to the conveying path defined on the paper feeding unit 34 side.

The latter conveying path includes a first discharge port 51 and a second discharge port 4. The first discharge port 51 is opened above the machine body 1*a*. The finisher is connected to the second discharge port 4. The discharge port 4 and the finisher 2 define a conveying path for a sheet.

The operation of the MFP 1 and the finisher 2 having the configurations explained above is explained below. A control method for the finisher 2 in discharging a sheet other than the long sheet from the MFP 1 to the fixed tray 11 is explained with reference to FIGS. 6A and 6B. In the figures, the image forming apparatus indicates the MFP 1 and the post-processing apparatus indicates the finisher 2.

Figure 6A:
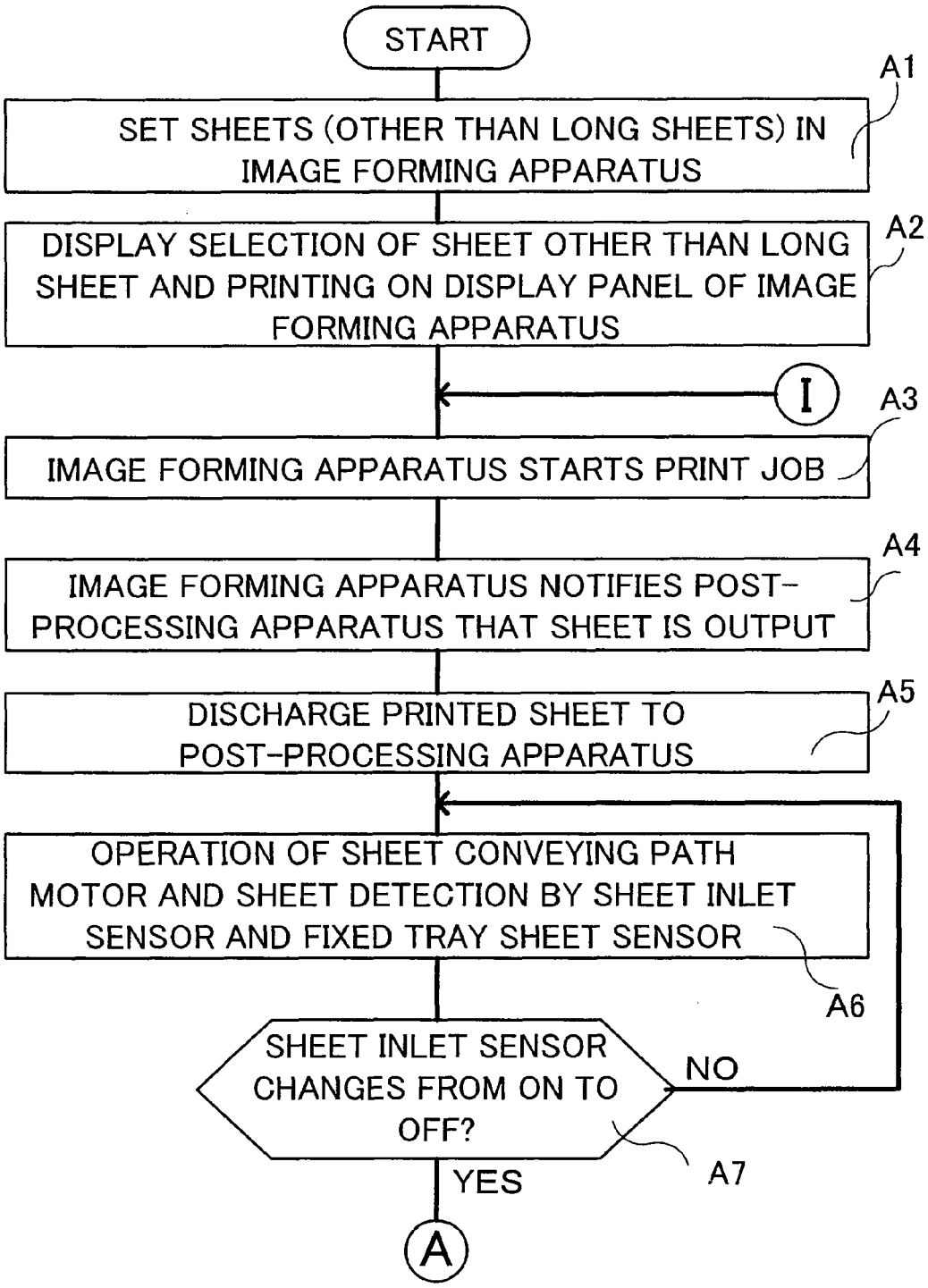
FIG. 6A is a first flowchart for explaining a post-processing method for standard size sheets of the sheet post-processing apparatus.
Figure 6B:
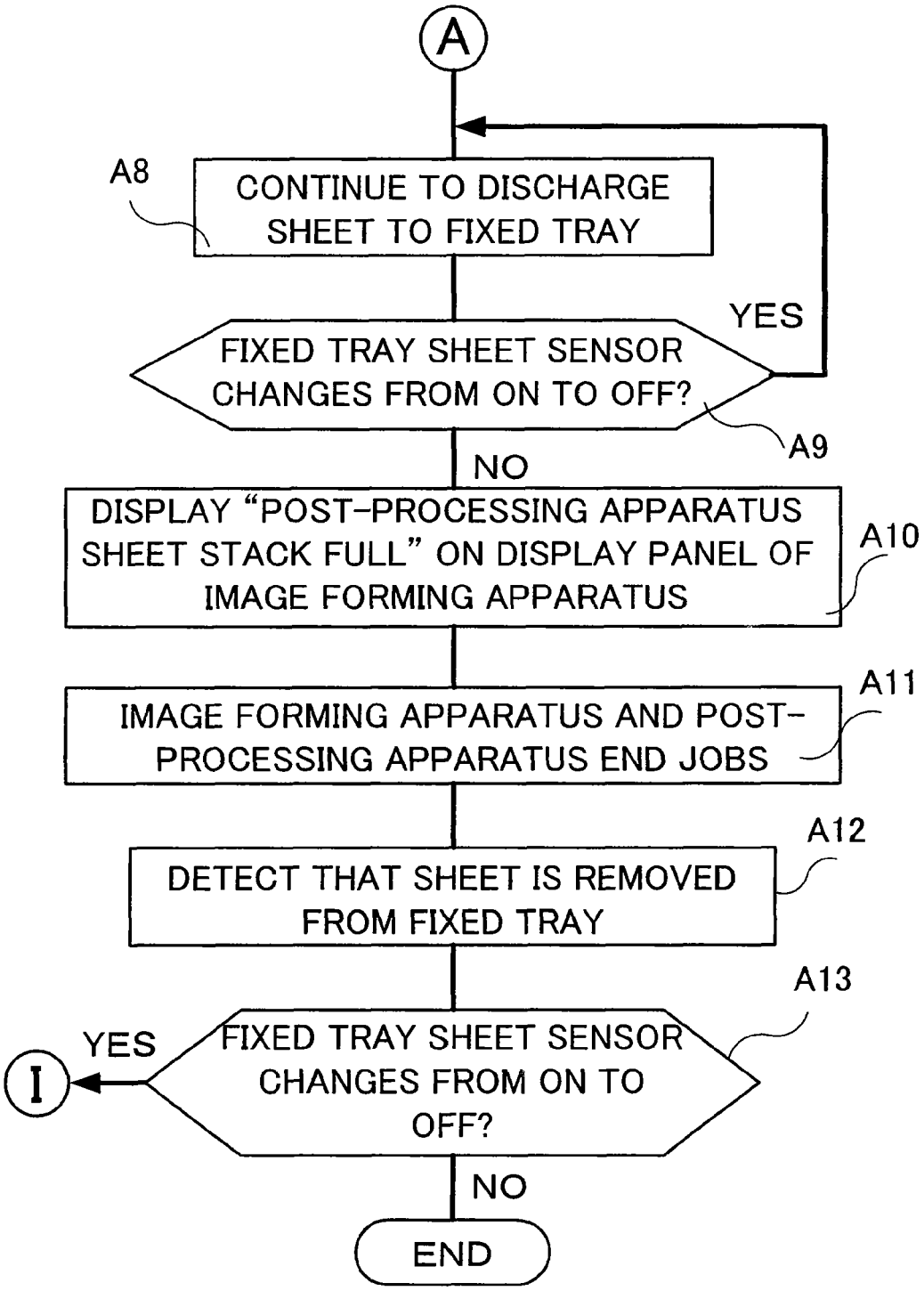
FIG. 6B is a second flowchart following FIG. 6A.

FIG. 6A is a first flowchart for explaining a post-processing method for the standard size sheet of the finisher 2. FIG. 6B is a second flowchart following FIG. 6A.

Prior to insertion of an original document, in Act A1, sheets are set in the manual feed tray 37 of the MFP 1. Alternatively, sheets are set in any one of the trays of the paper feeding unit 34.

In Act A2, the MFP 1 selectively displays a type of a sheet different from the long sheet using the display panel 38. The display panel 38 urges the user to start printing.

In Act A3, the MFP 1 starts execution of a print job. When an original document is inserted into the scanner unit 31, the MFP 1 picks up a sheet from the paper feeding unit 34 and executes an image forming process.

In Act A4, the MFP 1 notifies the finisher 2 of a processing request for the sheet through the signal line 14. The processing request includes information for identifying a sheet size, necessity of post-processing, a type of the post-processing, and a tray to which the sheet should be discharged.

In Act A5, the MFP 1 discharges the sheet.

When the processing request includes a standard size, unnecessity of the post-processing, and the fixed tray 11, the finisher control unit 13 causes the sheet conveying path motor 6*c* of the inlet roller pair 6 to start driving before a predetermined time elapses.

The finisher control unit 13 causes the directing member 7 to close the lower conveying path. The finisher control unit 13 causes the motor 10*c* of the last roller pair 10 to start driving.

The sheet inlet sensor 8 detects the leading end of the sheet. The finisher control unit 13 receives the input of ON from the sheet inlet sensor 8. Thereafter, the fixed tray sheet sensor 12 starts to detect the leading end of the sheet. The finisher control unit 13 receives the input of ON from the fixed tray sheet sensor 12.

In Act A6, the finisher control unit 13 detects that the sheet conveying path motor 6*c* is operating and that both the sheet inlet sensor 8 and the fixed tray sheet sensor 12 are on.

In Act A7, the finisher control unit 13 determines whether the sensor output of the sheet inlet sensor 8 changes from ON to OFF. While the sensor output does not change, through the NO route, the finisher control unit 13 repeats the processing in Act A6.

If the sensor output changes from ON to OFF, through the YES route (see a section marked A in the figure), the finisher control unit 13 drives the sheet conveying path motor 6*c* in Act A8 in FIG. 6B. The finisher 2 continues the discharge of the sheet to the fixed tray 11. The finisher control unit 13 continues feeding of the sheet by continuing to drive the motor 10*c*.

In Act A9, the finisher control unit 13 monitors whether the sensor output of the fixed tray sheet sensor 12 changes from ON to OFF.

The leading end of a cut sheet pushes up the leading end of the actuator 12*b* of the fixed tray sheet sensor 12. Thereafter, when the cut sheet drops to the stack surface of the fixed tray 11, the long sheet leading end falls.

Since cut sheets are conveyed one after another, the distal end of the fixed tray sheet sensor 12 repeats the rise and the fall. While the change is repeated, the finisher 2 continues to discharge the sheet (the YES route in Act A9).

In a state in which the distal end of the actuator 12*b* rises, the fixed tray sheet sensor 12 continues to output the same sensor value.

When the change does not occur and time in which the sensor output of the fixed tray sheet sensor 12 indicates ON continues exceeding a time threshold stored in advance, through the NO route in Act A9, the finisher control unit 13 turns on or turns on and off the LED 28 of the finisher panel 19 in Act 10. The finisher panel 19 displays "fixed tray sheet stack FULL".

In Act A11, the finisher 2 notifies the MFP 1 that "full" is detected. The finisher control unit 13 stops the job of the finisher 2. The MFP 1 stops the execution of the print job.

The user removes a bundle of sheets from the fixed tray 11. The distal end position of the actuator 12*b* changes from the upper position to the lower position with the own weight of the actuator 12*b*. The piece member 12*c* in the fallen state moves upward.

In Act A12, the finisher control unit 13 detects, on the basis of the output of the fixed tray sheet sensor 12, that the bundle of sheets is removed. The finisher control unit 13 stops the display of the finisher panel 19.

In Act A13, the finisher control unit 13 determines whether the sensor output of the fixed tray sheet sensor 12 changes from ON to OFF.

If the sensor output changes to OFF, through the YES route in Act A13 (see a section marked I), the finisher 2 transmits a message of restoration to the MFP 1 in Act A3 in FIG. 6A. The MFP 1 executes the print job.

If the finisher control unit 13 determines in Act A13 in FIG. 6B that the fixed tray sheet sensor 12 is not operating, through the NO route, the finisher control unit 13 ends the processing.

In FIGS. 6A and 6B, when the processing request includes an instruction for stapling, the finisher 2 processes sheets in the same manner as the example in which the post-processing is not performed.

The finisher control unit 13 causes the paper feeding roller pair 9, the roller pair on the processing tray 16, the paddle 20, the conveyor belt 22, and the like to operate. The finisher control unit 13 staples pages of sheets conveyed from the MFP 1 one after another and outputs a bundle of the sheets stapled in this way to the paper discharge tray 18.

A post-processing method for the finisher 2 in discharging the long sheet from the MFP 1 to the fixed tray 11 is explained with reference to FIG. 7.

Figure 7:
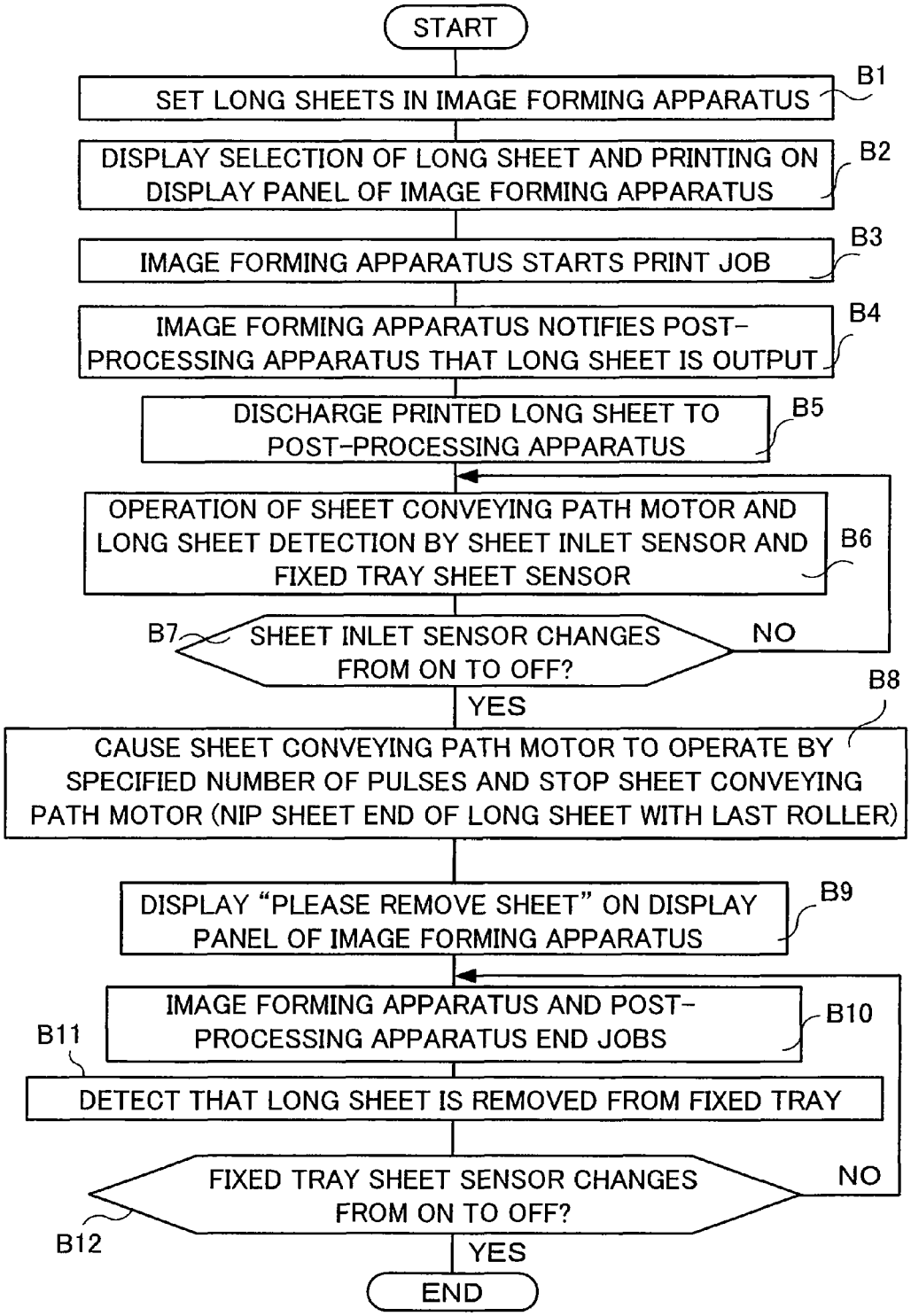
FIG. 7 is a flowchart for explaining a sheet post-processing method according to the first embodiment.

FIG. 7 is a flowchart for explaining the post-processing method for the long sheet of the finisher 2.

Prior to insertion of an original document, in Act B1, long sheets are set in the manual feed tray 37 of the MFP 1.

In Act B2, the MFP 1 selectively displays the long sheet using the control panel 36. The control panel 36 urges the user to start printing.

In Act B3, the MFP 1 starts execution of a print job. The MFP 1 executes an image forming process on the long sheet.

Alternatively, the MFP control unit 35 captures image data from a LAN (Local Area Network), a telephone line, or an externally-attached memory device, whereby the MFP 1 may form an image on the long sheet.

In Act B4, the MFP 1 notifies the finisher 2 of a processing request for designating the output of the long sheet and the fixed tray 11. The processing request may include the size of the long sheet.

In Act B5, the MFP 1 discharges the long sheet.

The finisher control unit 13 causes the sheet conveying path motor 6*c* to start driving before a predetermined time elapses. The finisher control unit 13 causes the directing member 7 to close the lower conveying path. The finisher control unit 13 causes the motor 10*c* to start driving.

The finisher control unit 13 receives the input of ON from the sheet inlet sensor 8. Thereafter, the finisher control unit 13 receives the input of ON from the fixed tray sheet sensor 12.

In Act B6, the finisher control unit 13 detects that the sheet conveying path motor 6*c* is operating and both the sheet inlet sensor 8 and the fixed tray sheet sensor 12 are on.

In Act B7, the finisher control unit 13 determines whether the sensor output of the sheet inlet sensor 8 changes from ON to OFF. While the sensor output does not change, through the NO route, the finisher control unit 13 continues to detect the long sheet.

If the sensor output changes from ON to OFF in Act B7, through the YES route, in Act B8, the finisher control unit 13 causes the sheet conveying path motor 6*c* to operate by a specified number of pulses and stops the motor driving. The finisher control unit 13 causes the last roller pair 10 to nip the trailing end of the long sheet.

The specified number of pulses is the number of steps of a stepping motor equivalent to a predetermined traveling distance of the long sheet. The predetermined traveling distance indicates a distance short enough for not bringing the leading end of the long sheet into contact with the floor surface.

The specified number of pulses mainly depends on the sheet length of the long sheet, the height and the full width in the front of the machine body 2*a*, the circumferential length of the inlet roller pair 6, the circumferential length of the last roller pair 10, and the like.

The finisher control unit 13 causes the motor 10*c* to operate by the specified number of pulses in synchronization with the rotation of the sheet conveying path motor 6*c*. Alternatively, the finisher control unit 13 stops only the rotation of the motor 10*c*. Alternatively, the finisher control unit 13 interrupts, with clutch control, conveyance force applied to the sheet by the motor 10*c*.

As shown in FIG. 2, the last roller pair 10 keeps the long sheet hanging from the fixed tray 11. The long sheet is kept nipped in the machine body 2*a*.

In Act 9B, the finisher control unit 13 causes the finisher panel 19 to display "please remove the sheet".

Since the sheet conveying path motor 6*c* and the motor 10*c* are stopped, the leading end of the long sheet keeps pushing up the distal end of the actuator 12*b*.

In the case of the standard size sheet, the finisher control unit 13 detects that the sensor output of the fixed tray sheet sensor 12 changes when both the operation of the inlet roller pair 6 and the operation of the last roller pair 10 are off.

In the case of the long sheet, the finisher control unit 13 detects that the fixed tray sheet sensor 12 continues to be on when both the operation of the input roller pair 6 and the operation of the last roller pair 10 are off.

In Act B10, the finisher 2 notifies the MFP 1 that the long sheet is nipped. The MFP 1 stops the print job and the finisher 2 stops the job.

In Act B11, the user depresses the confirmation button 28 of the finisher panel 19. The user removes the long sheet from the fixed tray 11. The long sheet is removed from the fixed tray 11. The sensor output of the fixed tray sheet sensor 12 changes from ON to OFF.

When the finisher control unit 13 detects the operation of the confirmation button 28, the finisher control unit 13 stops the display of the finisher panel 19.

In Act B12, the finisher control unit 13 determines whether the sensor output of the fixed tray sheet sensor 12 changes from ON to OFF. If the sensor output changes to OFF, through the YES route, the finisher control unit 13 ends the processing.

When the sensor output changes to OFF, the finisher 2 transmits a message of restoration to the MFP 1. The MFP 1 executes another print job.

If the sensor output of the fixed tray sheet sensor 12 continues to be on in Act B12, through the NO route, the finisher control unit 13 stands by for the next image forming process (Act B10).

The finisher 2 can hold the long sheet without along fixed tray for long sheet stacking or another paper discharge tray provided therein. The finisher 2 can hold the long sheet without an occupied area of the machine body 2*a* increased and apparatus height increased. Therefore, the problem in setting the finisher 2 is solved.

In the sheet post-processing apparatus according to the related art, it is difficult to stack the long sheet on the fixed tray or the movable tray without bending the long sheet and without scratching the long sheet.

In the sheet post-processing apparatus according to the related art, it is necessary to provide a dedicated component in order to stack the long sheet on the fixed tray without bending the long sheet and without scratching the long sheet.

A method of outputting a printed long sheet without bending the long sheet and without scratching the long sheet is attained by using the finisher 2 having a structural shape and size equivalent to a structural shape and size of the existing finisher.

(Modification of the First Embodiment)

The control panel 36 on the MFP 1 side may display indication that the control panel 36 urges the user to remove the long sheet.

As a modification of the example shown in FIG. 7, in Act B9, the finisher control unit 13 notifies the MFP control unit 35 that the long sheet is nipped. The MFP control unit 35 causes the control panel 36 to display "please remove the sheet".

As a modification of FIGS. 6A and 6B, in Act A9, if the sensor output of the fixed tray sheet sensor 12 continues to be on, through the NO route, in Act A10, the finisher control unit 13 notifies the MFP control unit 35 that the long sheet is nipped. The MFP control unit 35 causes the control panel 36 to display "fixed tray sheet stack FULL".

Since the MFP 1 is caused to execute the display function, it is easy to let the user notice that the long sheet is nipped.

It is also possible to implement, in the MFP control unit 35 of the MFP 1, application software for notifying, through a LAN connected to the MFP 1, a personal computer or a mobile terminal that sheets are fully stacked. This enables the notification reliable.

(Second Embodiment)

In the first embodiment, the MFP 1 fixes the long sheet with the nip force of the last roller pair 10 of the finisher 2. When a printed sheet is taken out, drawing force larger than the nip force is necessary. Therefore, the user consumes labor and time to draw out the sheet. The printed sheet is damaged.

In a second embodiment, the finisher 2 includes a nip-force releasing mechanism (a releasing mechanism). The nip-force releasing mechanism releases the nip force of the last roller pair 10 to take out the long sheet.

An image forming apparatus according to the second embodiment is also the MFP 1. A sheet post-processing apparatus according to the second embodiment is also a finisher coupled to the MFP 1. A nip-force releasing mechanism provided in the finisher is a manual mechanism.

A sheet post-processing method according to the second embodiment is also a method with which the finisher conveys the long sheet when the MFP applies printing to the long sheet.

Figure 8:
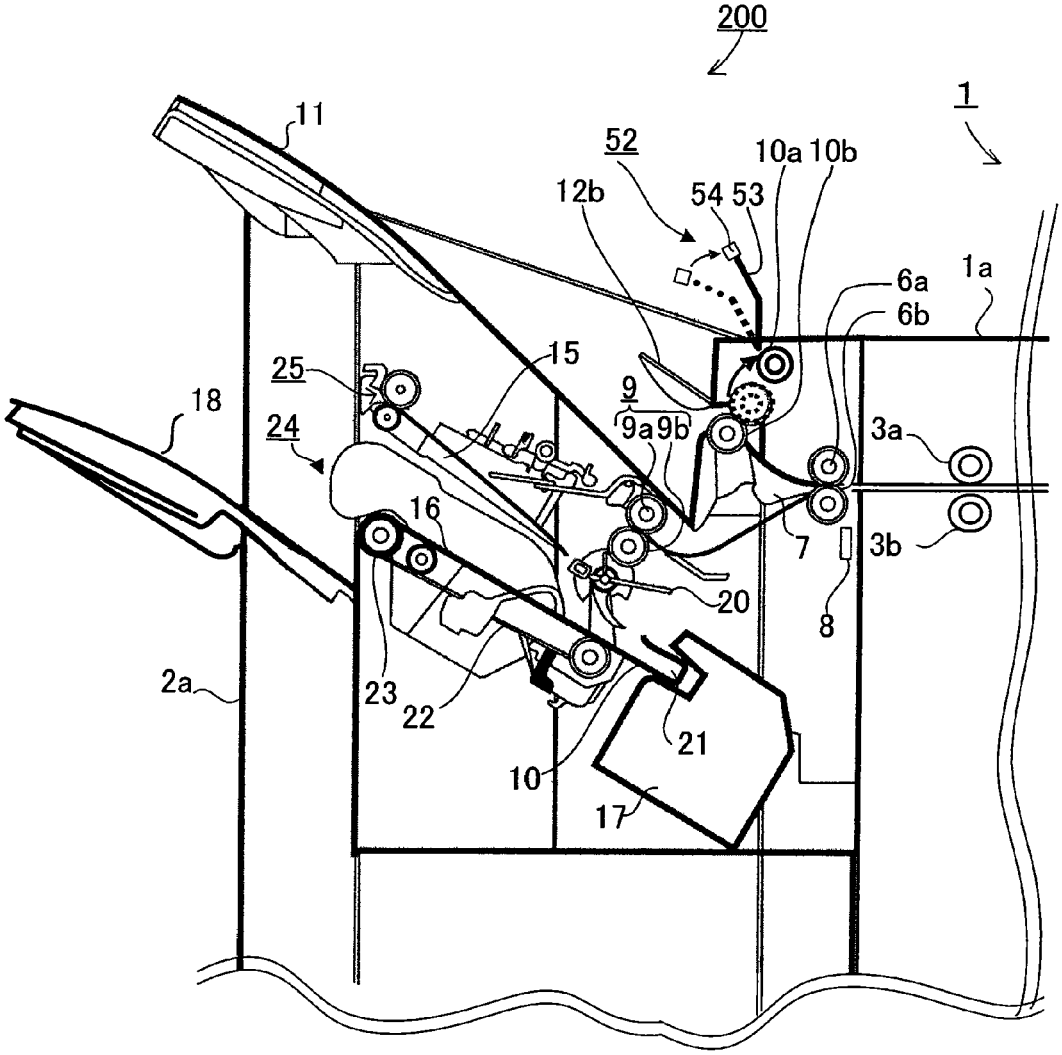
FIG. 8 is an enlarged diagram of a main part of a sheet post-processing apparatus according to a second embodiment.

FIG. 8 is an enlarged diagram of a main part of the finisher. Reference numerals and signs same as those described above denote the same components.

The MFP 1 and a finisher 200 are connected. A state in which the last roller pair 10 nips the long sheet and a state in which the last roller pair 10 releases the nip are shown in the figure.

As shown in FIGS. 1 and 8, the finisher 200 is configured by providing a nip releasing mechanism 52 in the finisher 2. The nip releasing mechanism 52 is fixed to the machine body 2*a*.

As an example, the nip releasing mechanism 52 includes a release lever 53 and a knob 54. A lower end of the release lever 53 is axially supported by a frame in the machine body 2*a*.

In a shaft body of the release lever 53, a section that comes into contact with the upper roller 10*a* moves the upper roller 10*a* to a nip position and a release position. The nip releasing mechanism 52 releases nip force generated by the upper roller 10*a* and the lower roller 10*b*.

The upper roller 10*a* is provided to be movable with respect to the machine body 2*a*. The upper roller 10*a* is located in the nip position where the upper roller 10*a* comes into contact with the lower roller 10*b* and the release position where the upper roller 10*a* separates from the lower roller 10*b*. The position of the lower roller 10*b* is fixed.

The upper roller 10*a* is applied with force for urging the upper roller 10*a* toward the lower roller 10*b*. A spring or a leaf spring generates the force.

The last roller pair 10 discharges the long sheet and the standard size sheet to the fixed tray 11.

After the sheet inlet sensor 8 detects the leading end of the long sheet, the inlet roller pair 6 and the last roller pair 10 convey the long sheet by a specified number of pulses in synchronization with each other.

Alternatively, the finisher control unit 13 stops only the inlet roller pair 6. Alternatively, the finisher control unit 13 interrupts conveying force applied to the long sheet by the motor 10*c*.

Thereafter, the inlet roller pair 6 and the last roller pair 10 stop. The last roller pair 10 in a halt nips the long sheet. The release lever 53 releases the nip force of the last roller pair 10.

Figure 9A:
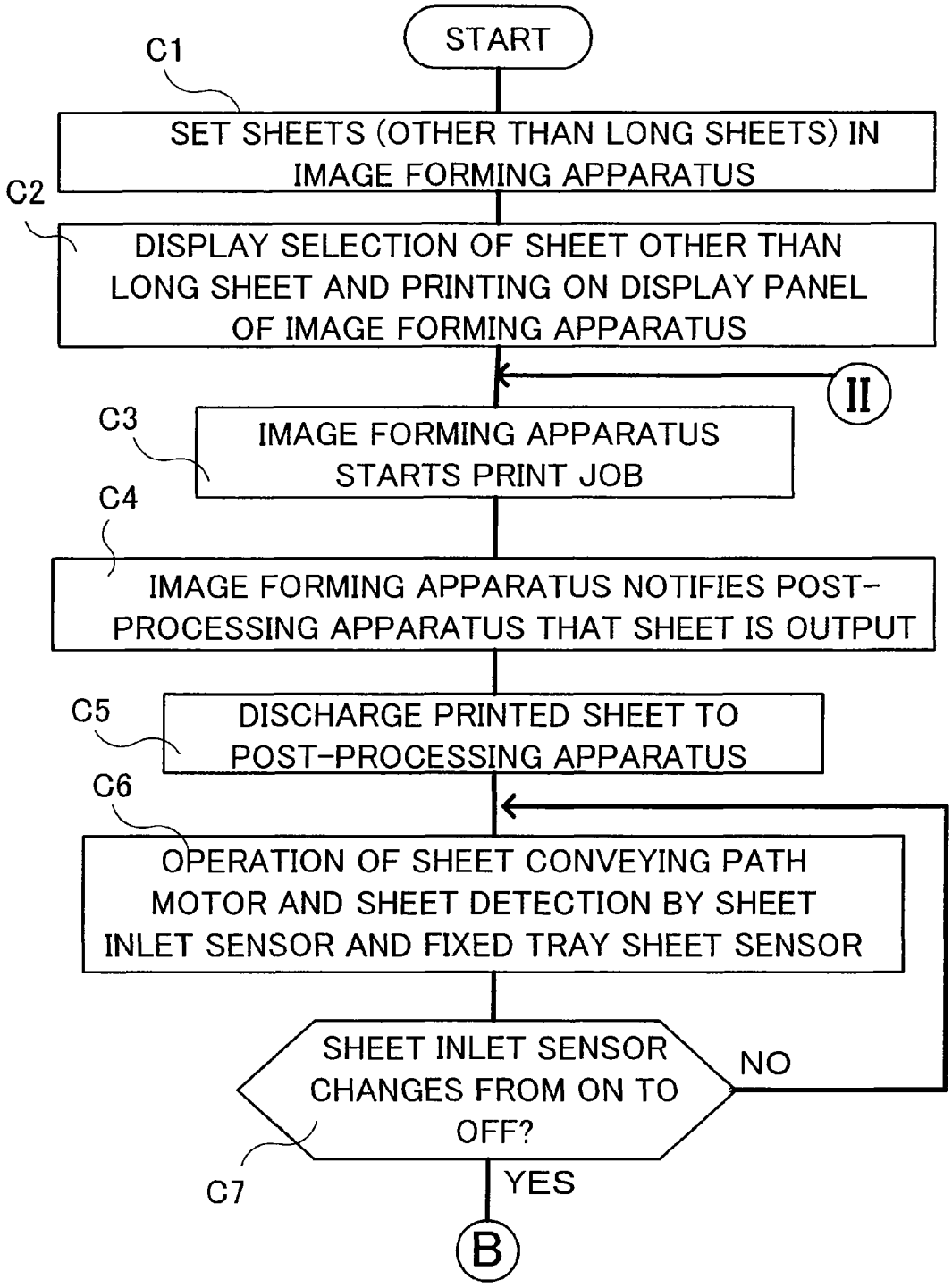
FIG. 9A is a first flowchart for explaining a post-processing method for standard size sheets of the sheet post-processing apparatus.
Figure 9B:
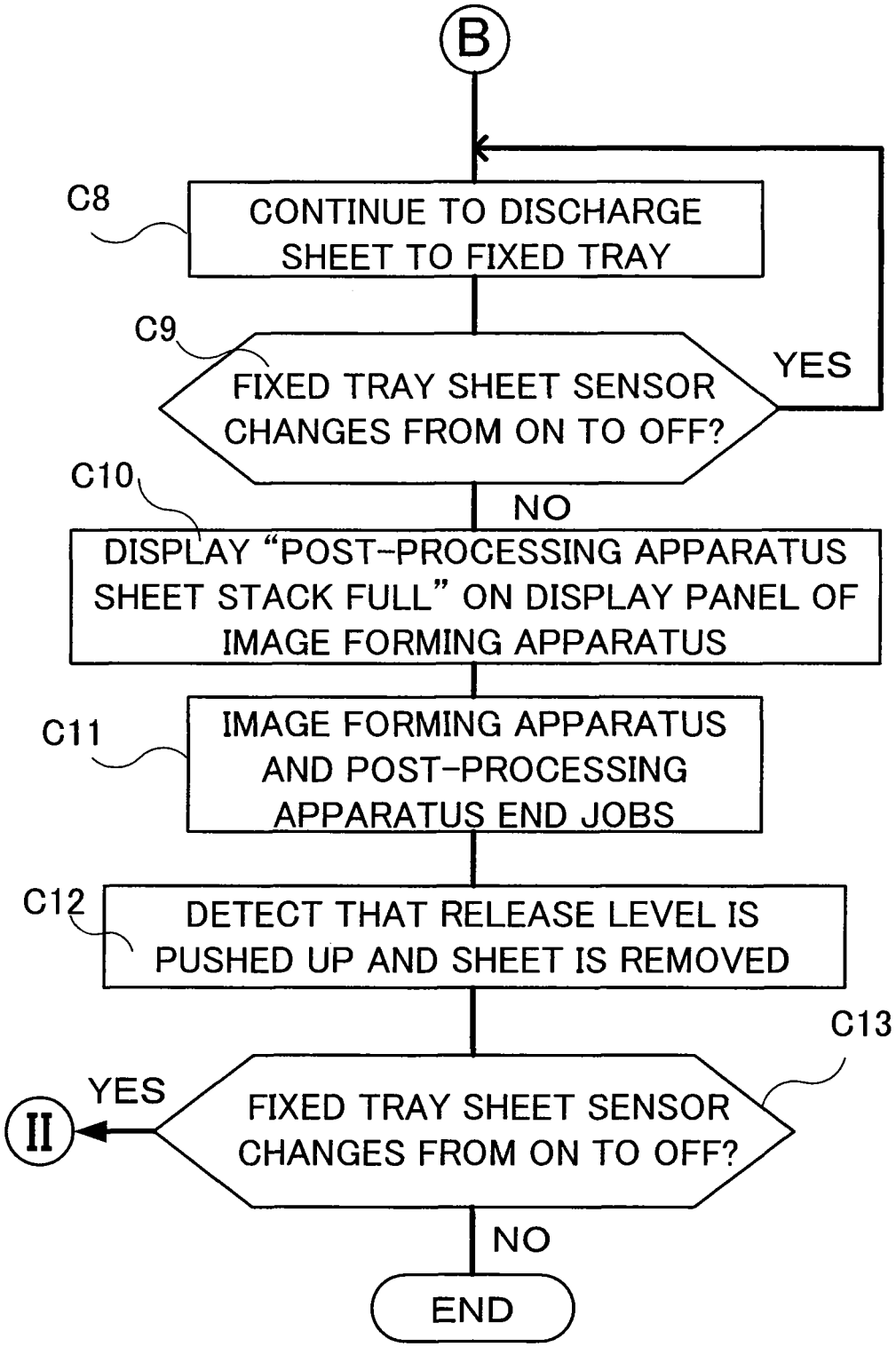
FIG. 9B is a second flowchart following FIG. 9A.

FIG. 9A is a first flowchart for explaining a post-processing method for the standard size sheet of the finisher 200. FIG. 9B is a second flowchart following FIG. 9A.

In the MFP 1, standard size sheets are set in the manual feed tray 37 or any one of the trays of the paper feeding unit 34 (Act C1).

The MFP 1 selectively displays a type of a sheet different from the long sheet and the display panel 38 urges a user to start printing (Act C2).

An original document is inserted into the scanner unit 31 and the MFP 1 starts execution of a print job (Act C3).

The MFP 1 notifies the finisher 200 that a sheet is output (Act C4). The finisher 200 causes the inlet roller pair 6, the directing member 7, and the last roller pair 10 to start to operate.

The MFP 1 discharges the standard size sheet (Act C5).

The finisher control unit 13 detects that the sheet conveying path motor 6*c* is operating and that both the sheet inlet sensor 8 and the fixed tray sheet sensor 12 are on (Act C6).

The finisher control unit 13 determines whether a sensor output of the sheet inlet sensor 8 changes from ON to OFF (Act C7). While the sensor output does not change, the finisher control unit 13 repeats the processing in Act C6 (the NO route in Act C7).

If the sensor output changes from ON to OFF (the YES route in Act C7), in Act C8 in FIG. 9B (see a section marked B), the finisher 200 discharges the sheet to the fixed tray 11. The finisher 200 continues to perform the discharge processing.

The finisher control unit 13 monitors whether the sensor output of the fixed tray sheet sensor 12 changes from ON to OFF (Act C9). While the change is repeated, the finisher 200 continues the discharge of the sheet (the YES route in Act C9).

If the sensor output of the fixed tray sheet sensor 12 continues to indicate ON (the NO route in Act C9), the finisher control unit 13 causes the finisher panel 19 to display "fixed tray sheet stack FULL" (Act 010).

The finisher control unit 13 stops the job of the finisher 200 (Act C11). The finisher 200 notifies the MFP 1 that the job is stopped, whereby the MFP 1 stops the execution of the print job (Act C11).

The user grasps the leading end of the standard size sheet. The user pushes up the release lever 53 of the nip releasing mechanism 52 provided in the last roller pair 10 near the fixed tray 11. The release lever 53 rotates with respect to the shaft of the lower roller 10*b*. The nip force is released. The position of the fixed tray sheet sensor 12 returns to the original position.

The finisher control unit 13 detects, on the basis of an output of the fixed tray sheet sensor 12, that a bundle of sheets is removed (Act C12).

The finisher control unit 13 determines whether the sensor output of the fixed tray sheet sensor 12 changes from ON to OFF (Act C13).

If the sensor output changes to OFF, in Act C13, though the YES route (see a section marked II), the MFP 1 executes a print job (Act C3 in FIG. 9A).

If the sensor output does not change to OFF (the NO route in Act C13 in FIG. 9B), the finisher control unit 13 ends the processing.

In FIGS. 9A and 9B, when a processing request includes an instruction for stapling, the finisher 200 staples pages.

A control method with which the finisher 200 discharges the long sheet from the MFP 1 to the fixed tray 11 is explained below with reference to FIG. 10.

Figure 10:
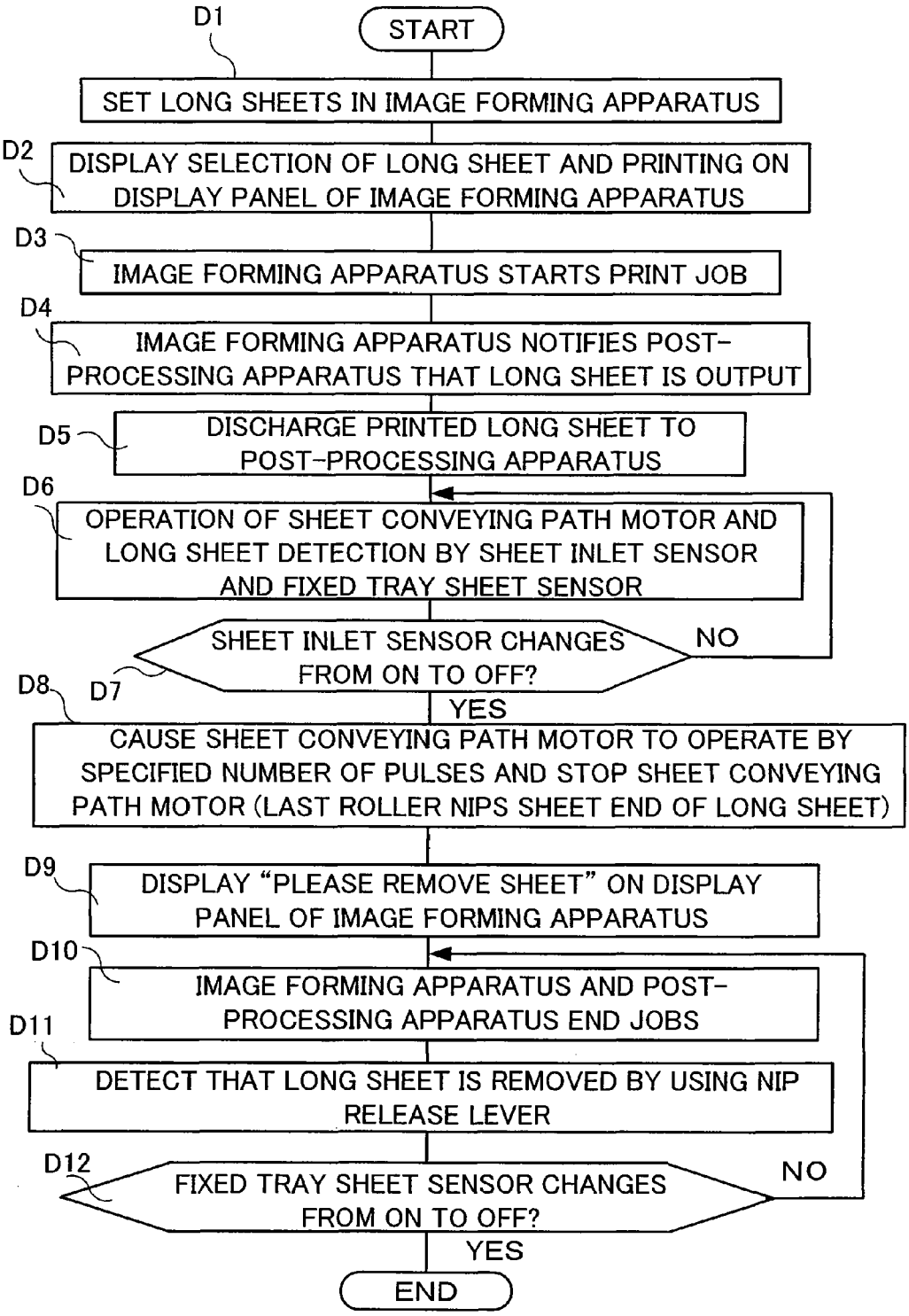
FIG. 10 is a flowchart for explaining a sheet post-processing method according to the second embodiment.

FIG. 10 is a flowchart for explaining a post-processing method for the long sheet of the finisher 200.

In the MFP 1, long sheets are set in the manual feed tray 37 (Act D1).

The MFP 1 selectively displays the long sheet. The display panel 38 urges the user to start printing (Act D2).

The MFP 1 starts execution of a print job (Act D3). The scanner unit 31 reads an original document or the MFP control unit 35 captures image data through a LAN, whereby the MFP 1 forms an image on the long sheet.

The MFP 1 notifies the finisher 2 of a processing request for designating the output of the long sheet and the fixed tray 11 (Act D4). The processing request may include the size of the long sheet.

The MFP 1 discharges the long sheet (Act D5).

The finisher control unit 13 causes the sheet conveying path motor 6*c* to start driving before a predetermined time elapses. The finisher control unit 13 causes the directing member 7 to close the lower conveying path. The finisher control unit 13 causes the motor 10*c* to start driving.

The finisher control unit 13 receives the input of ON from the sheet inlet sensor 8. Thereafter, the finisher control unit 13 receives the input of ON from the fixed tray sheet sensor 12.

The finisher control unit 13 detects that the sheet conveying path motor 6*c* is operating and both the sheet inlet sensor 8 and the fixed tray sheet sensor 12 are on (Act D6).

The finisher control unit 13 determines whether the sensor output of the sheet inlet sensor 8 changes from ON to OFF (Act D7). While the sensor output does not change (the NO route in Act D7), the finisher control unit 13 continues to detect the long sheet.

If the sensor output changes from ON to OFF (the YES route in Act D7), the finisher control unit 13 causes the sheet conveying path motor 6*c* to operate by a specified number of pulses and stops the motor driving (Act D8).

The finisher control unit 13 causes the motor 10*c* to operate by the specified number of pulses in synchronization with the rotation of the sheet conveying path motor 6*c*. Alternatively, the finisher control unit 13 stops only the motor 10*c* or interrupts conveying force applied to the long sheet by the motor 10*c*.

The finisher control unit 13 stops the motor driving for the last roller pair 10 and, at the same time, causes the last roller pair 10 to nip the trailing end of the long sheet. A state of the long sheet is changed to a state in which the long sheet is nipped by the last roller pair 10.

The finisher control unit 13 causes the LED 28 to display "please remove the sheet" (Act D9).

Since the sheet conveying path motor 6*c* and the motor 10*c* are stopped, the leading end of the long sheet keeps pushing up the distal end of the actuator 12*b*.

The MFP 1 stops the print job and the finisher 200 stops the job (Act D10).

The user pushes up the release lever 53 while grasping the leading end of the long sheet. The nip force is released. The position of the fixed tray sheet sensor 12 returns to the original position.

The finisher control unit 13 detects, on the basis of an output of the fixed tray sheet sensor 12, that the long sheet is removed (Act D11). The finisher control unit 13 stops the display of the finisher panel 19.

The finisher control unit 13 determines whether the sensor output of the fixed tray sheet sensor 12 changes from ON to OFF (Act D12). If the sensor output changes to OFF (the YES route), the finisher control unit 13 ends the processing.

If the sensor output of the fixed tray sheet sensor 12 continues to be on (the NO route in Act D12), the finisher control unit 13 stands by for the next image forming process (Act D10).

When the finisher 200 receives and discharges the long sheet output from the MFP 1, the last roller pair 10 nips the long sheet. When the user takes out the long sheet, the release lever 53 releases the nip force generated by the last roller pair 10. Therefore, it is possible to perform printing without bending the long sheet and without scratching the long sheet.

The finisher 200 can hold the long sheet without an occupied area of the machine body 2*a* and apparatus height increased.

Therefore, it is possible to handle the long sheet without providing a dedicated component in the sheet post-processing apparatus according to the related art. A high function can be imparted to the finisher 200 by attaching the nip releasing mechanism 52 to the sheet post-processing apparatus according to the related art and rewriting the ROM.

In the first embodiment, when the last roller pair 10 nips the long sheet, if the user pulls out the long sheet, it is likely that the last roller pair 10 steps out. With the finisher 200, it is possible to remove the long sheet without causing the step-out.

(Modification of the Second Embodiment)

The control panel 36 on the MFP 1 side may display indication that the control panel 36 urges the user to remove the long sheet.

In Act D9 in FIG. 10, the finisher control unit 13 notifies the MFP control unit 35 that the long sheet is nipped. The MFP control unit 35 causes the control panel 36 to display "please remove the sheet". Therefore, it is easy to let the user to notice that the long sheet is nipped.

If the senor output of the fixed tray sheet sensor 12 continues to be on in Act C9 in FIG. 9B, through the NO route, in Act C10, the finisher control unit 13 notifies the MFP control unit 35 that the long sheet is nipped. The MFP control unit 35 causes the control panel 36 to display "fixed tray sheet stack FULL".

It is also possible to implement, in the MFP control unit 35 of the MFP 1, application software for notifying, through a LAN connected to the MFP 1, a personal computer or a mobile terminal that sheets are fully stacked.

(Third Embodiment)

A puncher unit and a unit configured to divide a conveying path may be provided between the sheet post-processing apparatus and the MFP 1.

Figure 11:
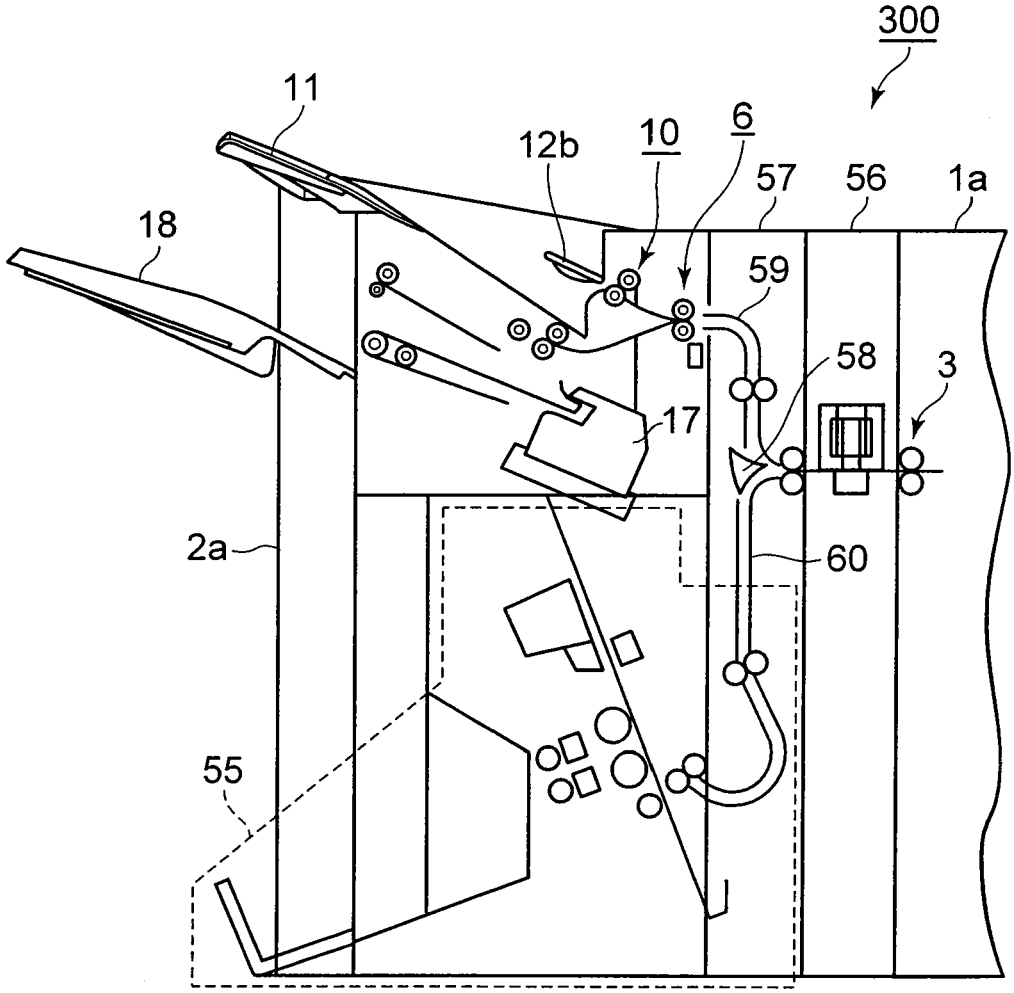
FIG. 11 is an enlarged diagram of a main part of a sheet post-processing apparatus according to a third embodiment.

FIG. 11 is an enlarged diagram of a main part of a sheet post-processing apparatus according to a third embodiment. Reference numerals and signs same as those described to above denote the same components.

A sheet post-processing apparatus 300 conveys a sheet to a unit on a side on which the stapler 17 is mounted or a saddle unit 55 and performs post-processing. The saddle unit 55 performs post-processing such as saddle stapling and saddle folding for pages.

The sheet post-processing apparatus 300 includes a puncher unit 56 configured to punch the sheet. The sheet post-processing apparatus 30 includes a sheet directing unit 57 configured to direct the sheet to the saddle unit 55 side or the fixed tray 11 side.

The sheet directing unit 57 includes a directing member 58, an upper sheet conveying path 59 to the fixed tray 11, and a lower sheet conveying path 60 to the saddle unit 55.

The sheets are supplied to the inlet roller pair 6 as the first roller pair from the sheet directing unit 57.

With such a configuration, the MFP 1 prints the long sheet. The puncher unit 56 punches the long sheet.

It is possible to perform printing, punching, saddle stapling, and the like without bending the long sheet and without scratching the long sheet. The release lever 53 may be provided in the sheet post-processing apparatus 300 to release nip force.

The finisher panel 19 or the control panel 36 may display FULL.

(Other Embodiments)

An image forming apparatus according to an embodiment may be a monochrome copying machine, a printer, or a facsimile.

The structure of the fixed sensor sheet sensor 12 shown in FIG. 4 can be variously changed. The superiority of the embodiments is not spoiled at all with respect to embodiments merely carried out by changing the structure of the fixed tray sheet sensor 12.

As specific examples of the standard sizes, the ISO A3 size is width 297 mm×length 420 mm and the A4 size is width 210 mm×length 297 mm. The LD size for the North America is width 432 mm×length 279 mm, the tabloid size is width 279 mm×length 432 mm, the LG size is width 216 mm×length 356 mm, and the LT size is width 216 mm×length 279 mm.

When the tray length of the fixed tray 11 is adjusted to the sheet length of the A4 size, A4, LD, and LT sheets do not fall from the fixed tray 11.

The sheet lengths of A3, tabloid, and LG sheets are larger than the tray length of the fixed tray 11. After the sheets are conveyed to the fixed tray 11, the sheets fall onto the floor surface from the fixed tray 11.

With the finishers 2, 200, and 300, it is possible to output, for example, a long sheet having length several times as large as the sheet length of the A4 size without dropping the long sheet onto the floor surface.

The finishers may execute, on the A3, tabloid, and LG sheets, processing same as the processing for the long sheet.

The sensor 12*d* may be a micro switch instead of the photointerrupter. The micro switch has an energized fixed contact. A movable contact is provided in the piece member 12*c*, whereby the sensor 12*d* detects on and off between the fixed contact and the movable contact.

While certain embodiments have been described, these embodiments have been presented by way of example only, and are not intended to limit the scope of the inventions. Indeed, the novel methods and apparatus described herein may be embodied in a variety of other forms; furthermore various omissions and substitutions and changes in the form of methods and systems described herein may be made without departing from the sprit of the inventions. The accompanying claims and their equivalents are intended to cover such forms or modifications as would fall within the scope and sprits of the inventions.

What is claimed is:

1. A sheet post-processing apparatus comprising:

a machine body having a post-processing mechanism configured to apply post-processing to a sheet;

a first roller pair provided in the machine body and configured to receive a sheet on which an image is formed by an image forming apparatus and nip and convey the sheet;

a fixed tray that is provided downstream with respect to the first roller pair in a sheet conveying direction, has a tray length in the sheet conveying direction, and is inclined upwardly from a first end to a second end that is located down in the sheet conveying direction with respect to the first end, and the sheet discharged from the first roller pair being stacked thereon;

a second roller pair provided between the fixed tray and the first roller pair and configured to nip and convey the sheet;

a display configured to indicate that the sheet is nipped by the second roller pair or that the fixed tray is full;

a driving unit configured to drive the second roller pair to convey the sheet by a distance that is greater than the tray length in a state in which the sheet is nipped by the second roller pair;

an inlet sensor configured to detect presence or absence of the sheet in the first roller pair;

a receiver configured to receive, from the image forming apparatus, sheet length information of the sheet; and a controller configured to control the driving unit to stop rotation of the second roller pair and to keep nipping the sheet, and control the display to indicate that the sheet held on the fixed tray is nipped by the second roller pair, in response to the receiver receiving sheet length information indicating that the sheet has a length in the sheet conveying direction that is longer than a predetermined length and the inlet sensor detecting a trailing end of the sheet.

2. The apparatus according to claim 1, wherein the controller is configured to control the display to indicate that the sheet is nipped by the second roller pair, after controlling the driving unit to rotate the rollers of the second roller pair a predetermined number of revolutions.

3. The apparatus according to claim 1, wherein the driving unit is configured to drive the first roller pair, and the controller is configured to control the driving unit so that the first roller pair conveys the sheet by a distance equivalent to the length of the sheet in the sheet conveying direction and keeps nipping the trailing end of the sheet.

4. The apparatus according to claim 1, further comprising:

a sheet sensor configured to be triggered under different conditions including when the fixed tray is full, wherein the controller is configured to control the display to indicate that the fixed tray is full, in response to the controller receiving a signal from the sheet sensor indicating that the sheet sensor has been triggered and the receiver receiving sheet length information indicating that the sheet has a length that is shorter than the predetermined length.

5. The apparatus of claim 4, further comprising a transmitter configured to transmit a control signal indicating that printing is permitted to the image forming apparatus, wherein the controller is configured to control the transmitter to transmit the control signal, when the sheet sensor is not triggered.

6. The apparatus according to claim 1, further comprising a releasing mechanism configured to decrease a nip force applied to the sheet by the second roller pair so that the sheet is released from being nipped by the second roller pair.

7. The apparatus according to claim 6, wherein the releasing mechanism includes a manual lever that is operated to separate one roller of the second roller pair from the other roller and release the sheet from being nipped by the second roller pair.

8. An image forming apparatus comprising:

a machine body connected to a sheet post-processing apparatus configured to apply post-processing to a sheet, the sheet post-processing apparatus including a fixed tray that has a tray length in a sheet conveying direction and that is inclined upwardly from a first end to a second end that is disposed downstream in the sheet conveying direction with respect to the first end;

a display configured to indicate a state in which the sheet held on the fixed tray is nipped and a state in which the fixed tray is full;

a discharging port provided in the machine body and configured to discharge the sheet to the sheet post-processing apparatus;

an image forming unit provided in the machine body and configured to form an image on the sheet;

a conveying mechanism configured to convey the sheet from the image forming unit through a conveying path to the discharging port;

a manual feed tray from which the sheet is supplied into the conveying path;

a transmitter configured to transmit, to the sheet post-processing apparatus, sheet length information of the sheet; and a controller configured to cause the transmitter to transmit sheet length information indicating that the sheet has a length in the sheet conveying direction that is longer than a predetermined length.

9. The apparatus according to claim 8, wherein the controller is configured to control the display to indicate that the sheet is in a nipped state, in response to being notified from the sheet post-processing apparatus that the sheet post-processing apparatus is nipping the sheet.

10. The apparatus according to claim 9, wherein, the controller is configured to control the display to indicate that the fixed tray is full, in response to a notification indicating that the sheet is in a nipped state and the fixed tray is full, when the sheet stacked on the fixed tray has a length that is shorter than the predetermined length.

11. The apparatus according to claim 10, further comprising a receiver configured to receive a control signal indicating that printing is permitted from the sheet post-processing apparatus, wherein in response to the receiver receiving the control signal the controller causes the image forming unit to start forming the image on the sheet.

* * * * *